US006368238B1

(12) United States Patent
Kasashima et al.

(10) Patent No.: US 6,368,238 B1
(45) Date of Patent: Apr. 9, 2002

(54) DIMPLED GOLF BALL

(75) Inventors: Atsuki Kasashima; Kazuto Maehara; Keisuke Ihara, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/487,777

(22) Filed: Jan. 20, 2000

(30) Foreign Application Priority Data

Jan. 27, 1999 (JP) ..... 11-018298

(51) Int. Cl.[7] ..... A63B 37/14
(52) U.S. Cl. ..... 473/383
(58) Field of Search ..... 473/378, 383, 473/384

(56) References Cited

U.S. PATENT DOCUMENTS

| | | | | |
|---|---|---|---|---|
| 4,560,168 A | * | 12/1985 | Aoyama | 473/383 |
| 4,979,747 A | * | 12/1990 | Jonkouski | 473/383 |
| 5,016,887 A | * | 5/1991 | Jonkouski | 473/383 |
| 5,158,300 A | * | 10/1992 | Aoyama | 473/384 |
| 5,967,908 A | | 10/1999 | Yamagishi et al. | 473/373 |

* cited by examiner

*Primary Examiner*—Mark S. Graham
*Assistant Examiner*—Raeann Gordon
(74) *Attorney, Agent, or Firm*—Sughrue Mion, PLLC

(57) ABSTRACT

In a golf ball having a plurality of dimples (12) formed in its surface, each dimple prior to paint coating consists of a major concave surface portion (20) circumscribed by a peripheral convex surface portion (22). The peripheral convex surface portion connects to the major concave surface portion at a point of inflection (30) which is located at a distance of 10–50% of the dimple depth (d) from the edge (26) of the peripheral convex surface portion.

14 Claims, 2 Drawing Sheets

DIMPLED GOLF BALL

BACKGROUND OF THE INVENTION

Well-known golf balls include solid golf balls comprising a solid core of hard rubber and a cover based on an ionomer resin and wound golf balls comprising a wound core consisting of a center and thread rubber wound thereon and a balata cover. Both types of golf balls have a plurality of dimples distributed over the entire spherical surface. In a common procedure, logo and other marks are printed onto the dimpled spherical surface, and a paint, typically clear paint is applied for the purposes of protecting the cover and improving the outer appearance before the ball is completed as a commercial product.

Referring to FIG. 3, the dimple is described in detail. FIG. 3 is a fragmental enlarged view showing the radial cross-sectional shape of one dimple 12 formed in the surface of a golf ball prior to paint coating. Most often, the dimple 12 is circular in plane shape and has a diameter of roughly 3 mm. A plurality of such dimples are distributed at a close spacing over the entire ball surface.

In general, dimples are formed in the golf ball surface as recesses or indentations. The cross-sectional shape of dimples is defined by a portion of a curved surface such as a circle, ellipse or hyperellipse. For example, the cross-sectional shape of the curved surface of the dimple 12 in FIG. 3 is a portion of a circle.

The dimple is circumscribed by an upper edge 26 which is continuously connected to a land 14 of the golf ball surface where no dimples are formed. The edge 26 is generally beveled from the land 14 as a steep slope to form the dimple. The edge 26 is formed angular prior to paint coating and somewhat rounded after paint coating.

As a general rule, the diameter S of the dimple 12 is determined on the basis of the geometry (often circular) circumscribed by the dimple edge 26. The depth or deepest value of the dimple is given by the distance from a plane (circle) 28 circumscribed by the edge 26 to the bottom or deepest point 24, rather than the distance between the bottom 24 and the original ball surface depicted by an imaginary extension line 15 drawn on the assumption that the ball has no dimples. Accordingly, the edge 26 of the dimple becomes a very important basic point when the diameter and depth of the dimple are determined.

However, when paint is applied to dimples having angular edges, the paint coating becomes a largely varying coating which is thin near the edge 26, because of the steep inclination from the edge 26 toward the bottom of the dimple, and forms a buildup at the bottom of the dimple. Besides, when logo and other marks are printed prior to painting, there is a likelihood that print skips occur in areas from the edge to the inside of dimples.

In particular, the paint coating thickness variations in dimples are serious in the sense that even if dimples are formed exactly to the designed configuration prior to painting, the dimples on the ultimately finished golf ball are more or less altered by the paint coating, resulting in a lower dimple precision.

SUMMARY OF THE INVENTION

An object of the invention is to provide a dimpled golf ball which is minimized in print skip and coating disparity and can maintain the desired dimple precision even after paint coating.

The invention provides a golf ball having a plurality of dimples formed in its surface. Each dimple prior to paint coating consists of a major concave surface portion defining a recess in the ball surface and a peripheral convex surface portion circumscribing the major concave surface portion. The dimple has a bottom, a peripheral edge and a depth therebetween. The peripheral convex surface portion connects to the major concave surface portion at a point of inflection which is located at a distance of 10 to 50% of the dimple depth from the dimple edge. Preferably the peripheral convex surface portion has a radius of curvature of 0.3 mm to 3.0 mm.

The invention has been made in consideration of the process for the manufacture of a golf ball having a plurality of dimples in its surface, involving the steps of printing logo and other marks and applying a clear paint to the ball surface where dimples of the desired design have been formed. The dimples in the ball surface prior to paint coating are configured to include a major curved surface portion defining a recess in the ball surface and a peripheral curved surface portion connected to the major curved surface portion. The boundary or point of inflection between the major and peripheral curved surface portions is optimized relative to the dimple depth. Then logo and other marks can be printed on the ball surface across the dimples without skipping. When a clear paint is coated thereon, a uniform paint film is obtainable. The painted golf ball maintains the precision of dimples substantially unchanged from prior to painting. It has also been found that paintability is further improved when the peripheral convex surface portion of the dimple has a radius of curvature of 0.3 to 3.0 mm.

DESCRIPTION OF THE PREFERRED EMBODIMENTS

Figure 1:
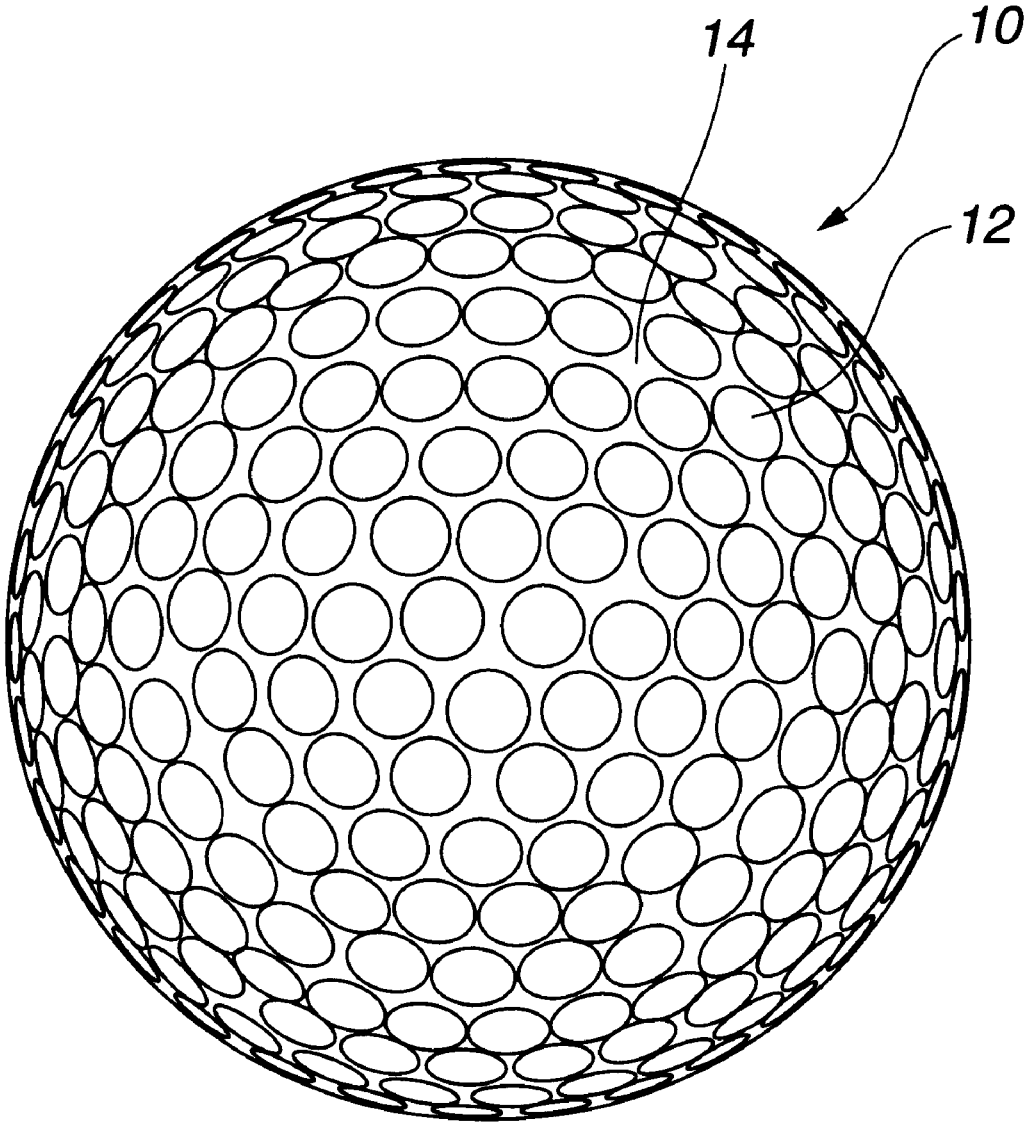
FIG. 1 illustrates a golf ball having dimples distributed on its surface.

Referring to FIG. 1, the golf ball designated at 10 according to the invention has a plurality of dimples 12 distributed on the spherical surface thereof. The arrangement and total number of dimples are not critical and may be properly selected within ranges that are well-known. For example, the dimple arrangement may be an octahedral, dodecahedral or icosahedral arrangement. The total number of dimples is generally from 250 to 600, and especially from 300 to 500.

Figure 2:
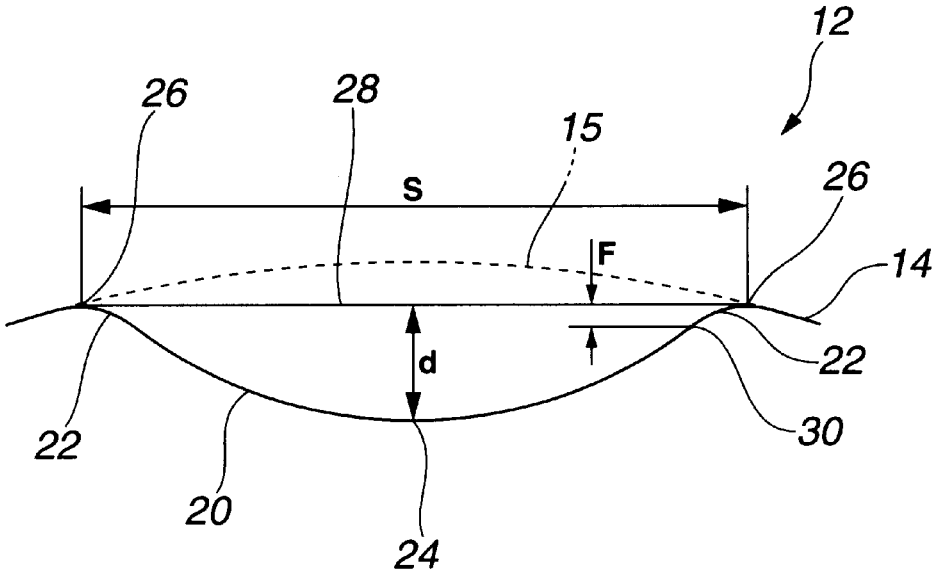
FIG. 2 is an enlarged cross-sectional view of a dimple configured according to the invention.

In the golf ball having a plurality of dimples formed in its surface, according to the invention, each dimple prior to paint coating consists of two curved surface portions. As shown in FIG. 2, the dimple includes a major curved or concave surface portion 20 which defines a recess indented toward the interior or center of the ball. The major concave surface portion 20 is circumscribed by a peripheral curved or convex surface portion 22 which is, in turn, connected to the land 14 of the ball.

The curved surfaces are described in more detail. The major concave surface portion 20 is a curved surface portion accounting for the majority of the dimple, and the bottom or deepest point 24 of the dimple is located at the center thereof. The peripheral convex surface portion 22 continuously circumscribes the major concave surface portion 20 at the inside and connects to the land 14 at the outside. The boundary between the peripheral convex surface portion 22 and the land 14 (or the intersection with a tangent to the land 14) becomes the upper edge 26 of the dimple. Most often, the major concave surface portion 20 is circular in plane shape.

The major concave surface portion 20 of the dimple has a radius of curvature $r_M$ whose center is located outside the ball. The peripheral convex surface portion 22 has a radius of curvature $r_E$ whose center is located inside the ball. It is recommended that the radius of curvature $r_E$ of the peripheral convex surface portion 22 is from 0.3 mm to 3.0 mm. The radius of curvature $r_M$ of the major concave surface portion 20 is usually from 3 mm to 20 mm though not limited thereto.

The dimple consists of two stages of curved surface, the major concave surface portion 20 and the peripheral convex surface portion 22. The boundary or point of inflection 30 between these two curved surfaces is optimized relative to the depth d of the dimple. The dimple depth d is defined as the distance between the bottom 24 of the major concave surface portion 20 and a plane 28 which is coextensive with the upper edge 26 of the peripheral convex surface portion 20.

According to the invention, the point of inflection 30 must be located at a distance F of 10 to 50% of the dimple depth d from the plane 28. If the point of inflection 30 is set at a distance of less than 10% of the dimple depth d from the plane 28, the peripheral convex surface portion accounts for too small portion of the dimple so that little improvement is made over the prior art dimples. If the point of inflection 30 is at a distance of more than 50% of the dimple depth d from the plane 28, the peripheral convex surface portion accounts for too large portion of the dimple (the major concave surface portion accounts for too small proportion of the dimple) so that the bottom portion of the dimple becomes narrower, failing to acquire the desired volume for the dimple. Although this inconvenience is overcome by increasing the dimple depth to an undesirable level, such deeper dimples are more likely to invite printing skips and when paint is applied, allow the paint to build up at the bottom.

As long as the dimple is configured to have two curved surface portions as described above, the diameter S and depth d of the dimple may be selected from well-known ranges. Measurement of diameter and depth is conventionally made using the edge 26 of the dimple as a reference. The dimple diameter S is the diameter of a plane 28 shape (typically circle) circumscribed by the dimple edge 26. The dimple depth d is the distance between the bottom 24 of the major concave surface portion 20 and the plane 28. It is often recommended that the dimple diameter S is from 2 mm to 5 mm, especially from 2.5 mm to 4.5 mm, and the dimple depth d is from 0.05 mm to 0.35 mm, especially from 0.1 mm to 0.3 mm.

Except for the above-mentioned dimples, the golf ball of the invention is not particularly limited with respect to its structure and construction. By using well-known ball materials and conventional manufacturing processes, the balls may be manufactured as solid golf balls including one-piece golf balls, two-piece golf balls, and multi-piece golf balls of three or more layers, and wound golf balls.

EXAMPLE

Examples of the invention are given below by way of illustration and not by way of limitation.

Figure 3:
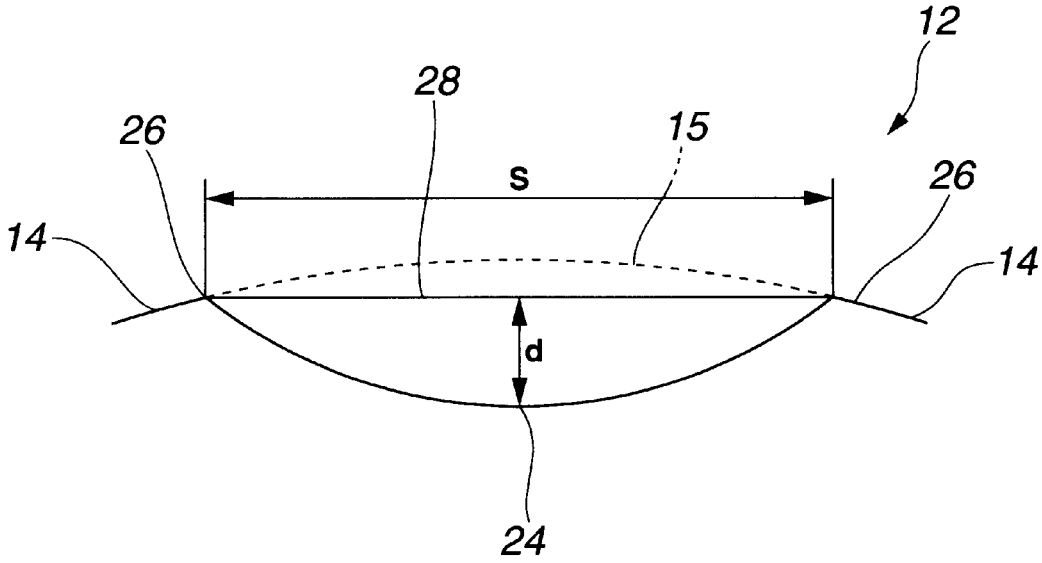
FIG. 3 is an enlarged cross-sectional view of a prior art dimple.

Two-piece solid golf balls of the same shape were manufactured using the same materials. Dimples were formed on the balls in the arrangement shown in FIG. 1. The balls of Example had dimples of the cross-sectional shape shown in FIG. 2 whereas the balls of Comparative Example had dimples of the cross-sectional shape shown in FIG. 3. Dimple parameters are shown in Table 1.

TABLE 1

| Dimple | Example | Comparative Example |
|---|---|---|
| Arrangement | FIG. 1 | FIG. 1 |
| Number | 396 | 396 |
| Diameter (mm) | 3.65 | 3.65 |
| Depth (mm) | 0.2 | 0.2 |
| Peripheral convex portion | present | absent |
| Major concave portion's radius of curvature (mm) | 9.2 | 9.5 |
| Peripheral convex portion's radius of curvature (mm) | 1.3 | — |
| Point of inflection (mm) | 0.06 | — |

Onto these dimpled golf balls, a clear paint was applied and dried. The outer appearance of the golf balls at different positions was visually observed to judge whether the appearance was passed or rejected. The results are shown in Table 2.

TABLE 2

| Golf ball | Example | Comparative Example |
|---|---|---|
| Land | Passed | Rejected |
| Dimple edge | Passed | Rejected |
| Dimple bottom | Passed | Rejected |
| Dimple intermediate | Passed | Rejected |

It is noted that the "dimple intermediate" is an intermediate area of the dimple surface between the edge and the bottom.

There has been described a golf ball bearing dimples of specific design. Ink printing and paint coating can be effected on the ball across dimples without skipping or variation. Even after painting, the dimples are maintained at a high precision.

Japanese Patent Application No. 11-018298 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball having a plurality of dimples formed in its surface, wherein each dimple prior to paint coating consists of a major concave surface portion defining a recess in the ball surface and a peripheral convex surface portion circumscribing the major concave surface portion, said dimple has a bottom, a peripheral edge and a depth therebetween, wherein the major concave surface portion of the dimple has a radius of curvature $r_M$ which is from 3 mm to 20 mm and whose center is located outside of the ball and the peripheral convex surface portion has a radius of curvature $r_E$ which is from 0.3 mm to 3.0 mm and whose center is located inside the ball, said peripheral convex surface portion connects to said major concave surface portion at a point of inflection which is located at a distance of F of 10 to 30% of the dimple depth d from the dimple edge.

2. The golf ball of claim 1, wherein the major concave surface portion of the dimple is a curved surface portion accounting for a majority of the dimple.

3. The golf ball of claim 1, wherein a dimple diameter S and a dimple depth d are from 2 mm to 5 mm and from 0.05 mm to 0.35 mm, respectively.

4. The golf ball of claim 1, wherein the total number of dimples is within the range of 250 to 600.

5. The golf ball of claim 1, wherein the total number of dimples is within the range of 300 to 500.

6. The golf ball of claim 1, wherein the bottom of the dimple depth d is located at the center of the dimple.

7. The golf ball of claim 1, wherein the point of inflection is located at a distance F of 10% to 20%.

8. The golf ball of claim 1, wherein the diameter of the dimple S is within the range of 2 mm to 5 mm.

9. The golf ball of claim 8, wherein the diameter of the dimple S is within the range of 2.5 mm to 4.5 mm.

10. The golf ball of claim 1, wherein a dimple depth d is within the range of 0.1 mm to 0.3 mm.

11. The golf ball of claim 1, wherein the golf ball is a multi-piece golf ball of three or more layers.

12. The golf ball of claim 1, wherein the golf ball is a one piece golf ball.

13. The golf ball of claim 1, wherein the golf ball is two-piece golf ball.

14. The golf ball of claim 1, wherein the golf ball is a wound golf ball.

* * * * *